United States Patent [19]

Tanaka et al.

[11] Patent Number: 4,634,258

[45] Date of Patent: Jan. 6, 1987

[54] COLOR COPYING MACHINE WITH COPY NUMBER COUNTING DEVICE FOR INDIVIDUAL COLOR PRINTING

[75] Inventors: Toyoki Tanaka, Yamatokoriyama; Ikuo Itoh, Nara, both of Japan

[73] Assignee: Sharp Kabushiki Kaisha, Osaka, Japan

[21] Appl. No.: 686,849

[22] Filed: Dec. 26, 1984

[30] Foreign Application Priority Data

Dec. 26, 1983 [JP] Japan ..... 58-202092[U]

[51] Int. Cl.[4] ..... G03G 15/01

[52] U.S. Cl. ..... 355/4; 355/14 CU; 355/14 D; 355/3 DD

[58] Field of Search ..... 355/4, 14 CU, 3 R, 14 R, 355/3 DD

[56] References Cited

U.S. PATENT DOCUMENTS 3,813,157 5/1974 Fantozzi ..... 355/14 CU
4,019,028 4/1977 Polyzoes ..... 355/14 CU X
4,058,815 11/1977 Warner et al. ..... 355/14 CU
4,165,165 8/1979 Iwami et al. ..... 355/4
4,189,224 2/1980 Sakai ..... 355/4
4,204,728 5/1980 Goshima et al. ..... 355/4

*Primary Examiner*—A. C. Prescott
*Attorney, Agent, or Firm*—Birch, Stewart, Kolasch & Birch

[57] ABSTRACT

Disclosed is an extremely convenient copying machine for performing copying operations using a selected color toner of internally provided color toner developer containers, which copying machine effectively provides means for cumulatively counting the number of copied papers processed by each color toner developer container. The preferred embodiment provides a plurality of counters for counting the number of copied papers provided for each color toner developer container, and feeds the counter pulses generated in each copying cycle to these counters according to the selected color of the internally installed color toner developer containers. A display unit is also provided so that the actual number of copied papers processed by each color toner developer container can be cumulatively displayed as required.

6 Claims, 3 Drawing Figures

COLOR COPYING MACHINE WITH COPY NUMBER COUNTING DEVICE FOR INDIVIDUAL COLOR PRINTING

BACKGROUND OF THE INVENTION

The present invention relates to a copying machine that performs a copying operation using a selected color of any desired color toner developer container internally provided.

Such a copying machine of this kind preliminarily prepares a plurality of color toner developer containers, for example, such as the one containing either black or red toner, so that any of these can be stored in the copying machine for use as required, thereby making it possible to perform a single-color copying operation using any toner color selected.

Conventionally, each of the color toner developer containers is provided with a counter that cumulatively counts the number of copied papers when this toner developer container is used. However, it will be quite convenient for maintenance services if it automatically identifies whether the toner is replenished or not by reading the counter content.

OBJECT OF THE INVENTION

In the light of such an existing inconvenience described above, the present invention aims at providing an extremely convenient copying machine capable of individually counting the cumulative number of the copied papers processed by each color toner developer container. Another object of the the present invention is to provide an extremely convenient copying machine capable of externally displaying the cumulative number of the copied papers processed by the color toner developer container using the display unit of the copying machine itself. The preferred embodiment of the present invention provides such a copying machine performing copying operations in a selected toner color using a desired color toner developer container internally installed, wherein a plurality of counters are provided for each color toner developer container counting the number of copied papers. Additionally, there is provided means for feeding pulses generated in each copying cycle to the counters counting the number of copied paper in response to the selected color of the toner developer container inside the copying machine.

Another preferred embodiment of the present invention incorporated in such a copying machine provides an external display cumulatively displaying the number of copied papers processed by each color toner developer container; a plurality of counters each counting the number of copied papers provided for each color toner developer container; switching means for feeding pulses generated in each copying cycle to these counters; and means for displaying the content of each counter. These means effectively allow the copying machine to correctly display the cumulative number of copied papers processed by each color toner developer container, thus providing a great convenience for checking the needs of replenishing color toner.

Further scope of patentability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
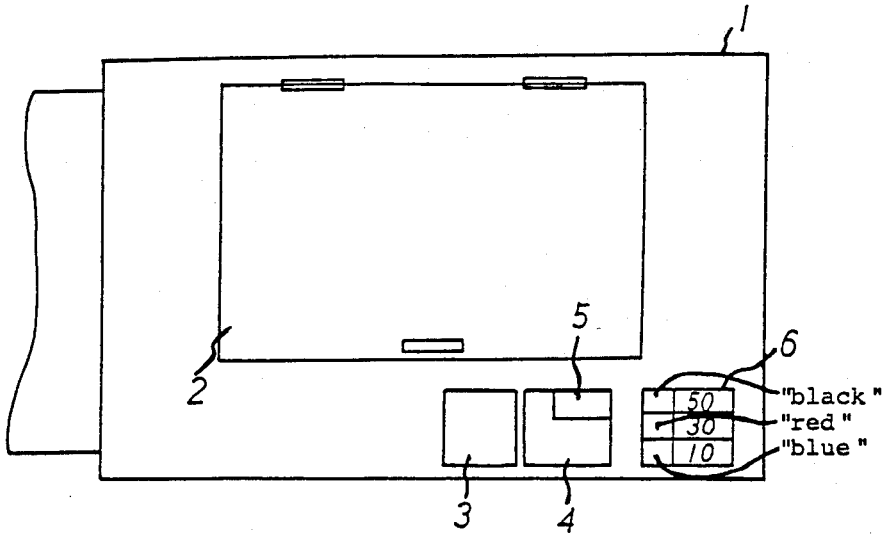
FIG. 1 is the operation panel of a copying machine incorporating the preferred embodiment of the present invention.

Referring now to the attached drawings, the preferred embodiments of the present invention are described below. FIG. 1 is the operation panel of a copying machine incorporating the preferred embodiment of the present invention. Reference number 1 indicates the copying machine, 2 the cover on the draft setter, 3 the copy start key, 4 digital keys setting the number of papers to be copied, and 5 the display digitally showing the number of copied papers. Reference number 6 indicates the display that cumulatively displays the number of copied papers processed by each color toner developer container. This display, for example, has a certain display area according to the number of the color toner developer containers, displaying the toner color to the left of the certain display area, whereas the cumulative number of the copied papers is digitally displayed to the right of the opposing area, respectively. Instead, it is also possible to use only one area so that either the needed toner color or the number of the copied paper can be selectively displayed.

Figure 2:
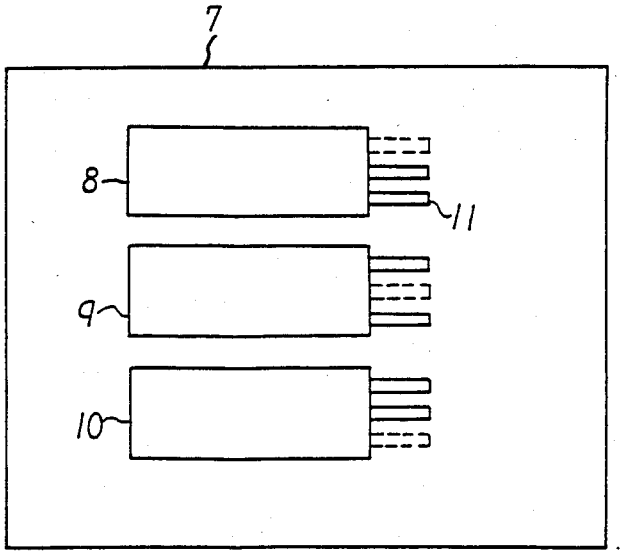
FIG. 2 is the connector for identifying the color toner developer containers.

FIG. 2 is the connector identifying the color toner developer containers stored in the copying machine. The connector unit 7 is, for example, composed of connector 8 connected to the black toner developer container, connector 9 connected to the red toner developer container, and connector 10 connected to the blue toner developer container 10, while each being connected to the corresponding developer container via pins 11 shown to the right of FIG. 2. To prevent incorrect connection of these connectors between each other, positions of respective pins 11 are different from connectors 8, 9, and 10. In the preferred embodiment, when the connector of the color toner developer container stored inside the copying machine is connected to any of these connectors 8, 9, or 10, switch 12 shown in FIG. 3 can be optionally turned to any of these connectors either by mechanical reaction at the time of their connection or by means of electric sensing operation.

Figure 3:
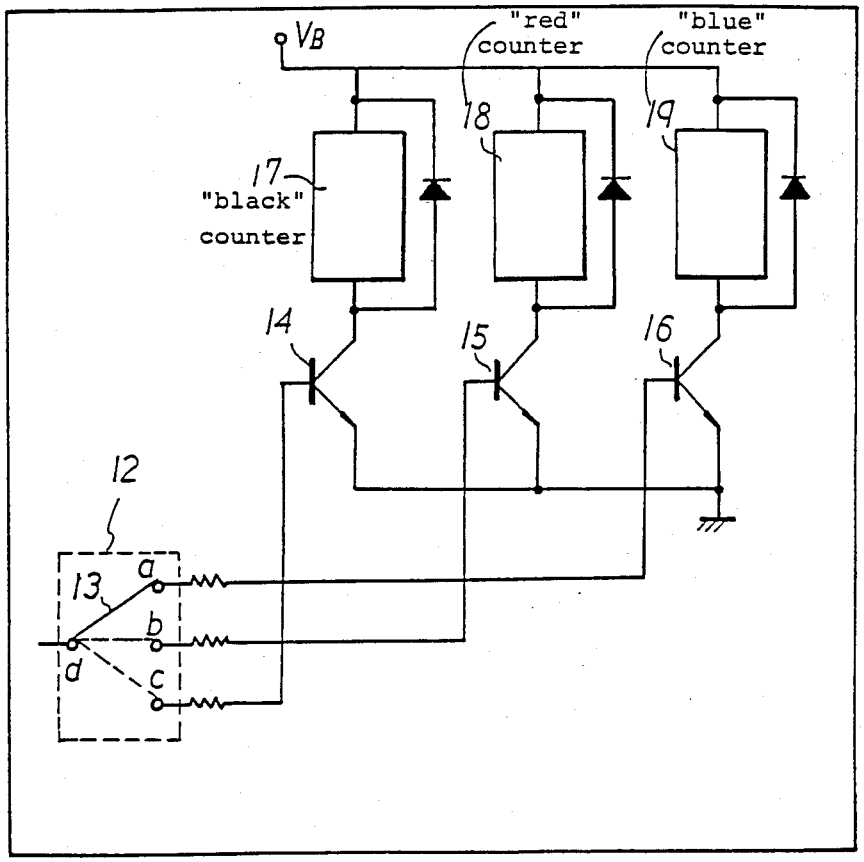
FIG. 3 is a simplified block diagram of a circuit for feeding pulses to counters respectively connected to the toner developer containers.

FIG. 3 shows such a circuit for feeding pulses to a plurality of counters connected to each color toner developer container stored in the copying machine. Switch 12 is composed of terminals a, b, c, and d plus a movable member 13, while terminal "d" receives the counter pulses generated in each cycle of the copying operation. The movable member 13 is connected to terminal "a" when the connector of the blue toner developer container is connected to connector 10, and to terminal "b" when the connector of the red toner developer container is connected to connector 9, and to terminal "c" when the black toner developer container is connected to connector 8, respectively. These switching operations can be performed either by mechanical or by electric means, and either of these may be used. Reference members 14, 15, and 16 respectively indicate switching transistors. As shown in FIG. 3, bases of these transistors are connected to terminals a, b, and c of switch 12. Counter 17 cumulatively counts the number of copied papers processed by the black toner developer container connected to transistor 14, counter 18 cumulatively counts the number of copied papers processed by the red toner developer container connected to transistor 15, and counter 19 cumulatively counts the number of copied papers processed by the blue toner developer container connected to transistor 16, respectively. These counters may be comprised of, for example, read-write memory (RAM) in the control circuit of the copying machine. If this is made available, care should be taken to properly back up the interrupted power so that the memory content cannot be reset. Each counter content is digitally displayed in display 6 of the operation panel using a conventional display drive circuit.

Using such a configuration thus described, for example, when the connector of the red toner developer container installed in the copying machine is connected to connector 9, the movable member 13 of switch 12 is connected to terminal "b". If a copying operation is performed, the counter pulse is fed to the base of the switching transistor 15 via terminals "d" and "b" so that it turns ON to activate counter 18. Likewise, as soon as the black toner developer container is installed, counter 17 starts the counting operation. Also, as soon as the blue toner developer container is installed, counter 19 also starts the counting operation. As a result, number of the copied papers processed by each toner developer container is counted and memorized by RAM, while the content of each counter is digitally displayed in display 6 provided on the operation panel of the copying machine. This provides a great convenience for the operator to immediately identify which one of the toner developer containers needs a supply of color toner solvent.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A copying machine comprising:

a plurality of internally installed color toner developer containers;

a plurality of counters in a one-to-one correspondence with each of said plurality of color toner developer containers, said plurality of counters individually counting a cumulative number of photocopies made from each one of said color toner developer containers;

means for connecting said plurality of counters to said corresponding plurality of color toner developer containers;

selection means for selecting one of said plurality of color toner developer containers for use in providing photocopies of the selected color;

means, responsive to said selection means, for feeding counter pulses generated in each copying cycle of the selected color to said respective one of said plurality of counters;

display means for individually displaying a cumulative number of copies made by the copying machine from each of said color toner developer containers as counted by each of said plurality of counters; and display means for displaying a cumulative number of copies made by the copying machine as determined by a sum of each of said plurality of counters.

2. A copying machine according to claim 1, wherein said plurality of internally installed color toner developer containers include black, red, and blue containers.

3. A copying machine according to claim 1, wherein said means for feeding counter pulses is a circuit including said selection means, and a plurality of switching transistors corresponding to said plurality of counters.

4. A copying machine according to claim 1, wherein each of said plurality of counters includes a read-write memory in a control circuit of said copying machine.

5. A copying machine according to claim 3, wherein said selection means is an electrical switch having a plurality of switch contacts corresponding to said plurality of switching transistors, a terminal switch contact, and a movable connecting member in continuous contact with said terminal switch contact and in selective contact with said plurality of switch contacts, wherein said terminal switch contact receives counter pulses generated in each cycle of a copying operation and said plurality of switch contacts only receive counter pulses generated during selection of a specific color toner developer container in a copying operation.

6. A copying machine according to claim 1, wherein said means for connecting said plurality of counters to said corresponding plurality of color toner developer containers is a connector unit having a plurality of connectors therein, each of which correspond to a single one of said color toner developer containers, each of said connectors having a plurality of pins in a predetermined orientation for enabling an exact connection between a counter and a correct color toner developer container.

* * * * *